United States Patent [19]

Luo

[11] Patent Number: 4,708,100

[45] Date of Patent: Nov. 24, 1987

[54] TWO-STROKE ENGINE WITH INJECTED FUEL GASIFYING CHAMBER IN PISTON

[75] Inventor: Jih-Tzang Luo, Hsin Chu Hsien, Taiwan

[73] Assignee: Industrial Technology Research Institute, Hsin Chu Hsien, Taiwan

[21] Appl. No.: 947,086

[22] Filed: Dec. 29, 1986

[51] Int. Cl.[4] ..... F02B 33/04

[52] U.S. Cl. ..... 123/73 PP; 123/193 P; 123/545

[58] Field of Search ..... 123/73 R, 73 B, 73 A, 123/73 PP, 193 P, 545, 548, 557

[56] References Cited

U.S. PATENT DOCUMENTS

| | | | |
|---|---|---|---|
| 3,881,454 | 5/1975 | Jaulmes | 123/73 B |
| 3,993,030 | 11/1976 | Jaulmes | 123/73 B |
| 4,026,254 | 5/1977 | Ehrlich | 123/73 PP |
| 4,051,820 | 10/1977 | Boyesen | 123/73 PP |
| 4,067,302 | 1/1978 | Ehrlich | 123/73 PP |
| 4,286,553 | 9/1981 | Baltz et al. | 123/73 A |

*Primary Examiner*—Craig R. Feinberg
*Assistant Examiner*—David A. Okonsky
*Attorney, Agent, or Firm*—Cushman, Darby & Cushman

[57] ABSTRACT

It is a reciprocating type of internal combustion engine, of which the inside of piston is furnished with a gasifying chamber; the outlet of the gasifying chamber can, during the piston moving reciprocatingly, be in alignment with the spraying nozzle on the cylinder and the third scavenging passage in sequence so as to let the spraying nozzle directly spray fuel into the gasifying chamber, and to let the fuel absorb the high temperature heat of the piston top to cause the fuel to be gasified completely. The gasified fuel flows into the third scavenging passage during the piston moving downwards and is to be stored therein temporarily; then, the gasified fuel is compressed into the cylinder by means of the compressed air in the crankcase so as to mix with the fresh air entered into the cylinder via other scavenging passages. The gas mixture is to be compressed with the upward moving piston, and to be exploded to generate a mechanical power.

3 Claims, 5 Drawing Figures

TWO-STROKE ENGINE WITH INJECTED FUEL GASIFYING CHAMBER IN PISTON

BACKGROUND OF THE INVENTION

In the conventional two-stroke internal combustion engine, the inner surface of the cylinder is furnished with an exhaust port and a set of scavenging ports, which are controlled with the reciprocating piston to open and close. The upper edge of the exhaust port is above the upper edge of the scavenging ports so as to have the exhaust port opened first. After the power stroke of the aforesaid two-stroke internal combustion engine being completed, the waste gas in the cylinder is to be exhausted by means of gas mixture entered into the cylinder via the scavenging ports. In the two-stroke internal combustion engine that uses a carburetor, the air and fuel are pre-mixed into a homogeneous gas mixture, which is then conveyed into the cylinder, and which is also used for clearing the waste gas in the cylinder simultaneously.

For instance, a Japan patent application No. 51-39112 teaches a two-stroke internal combustion engine, in which a valve is furnished for opening or closing the exhaust port so as to have the height of the upper edge of the exhaust port become variable; the upper edge of the exhaust port is almost positioned above the upper edge of the scavenging ports.

In the aforesaid conventional two-stroke internal combustion engine, the exhaust port is opened earlier than the scavenging ports, but is closed later than the scavenging ports; therefore, a given portion of the gas mixture is to be blown off from the exhaust port upon the mixture entering into the cylinder via the scavenging ports; in other words, a considerable quantity of fuel is to be blown into the exhausting passage without being burned, that blow-off condition not only increases the fuel consumption, but also increases the HC quantity contained in the exhausted gas; that blow-off condition is particularly serious during the engine running in idle or low speed condition. That is the reason why the small vehicle with a two-stroke engine exhausts more HC in the waste gas during being stopped and the idle running period.

It is well known that the content of HC in the waste gas exhausted can be reduced by lowering the upper edge of the exhaust port to about the same level of the upper edge of the scavenging ports so as to reduce the blow-off volume; in that case, the scavenging efficiency of the engine will be reduced, and, as a result, the power output under normal using condition will be reduced; therefore, it is deemed impractical by lowering the upper edge of the exhaust port to prevent from leaking. Moreover, the height of the upper edge of the exhaust port may be changed by furnishing a valve, which can be opened at high speed running condition so as to make the upper edge of the exhaust port higher for increasing the power output; however, when the valve is under closed condition, the upper edge of the exhaust port is still at an ordinary height, being unable to prevent the blow-off condition from taking place.

There is an internal combustion engine that has no carburetor; the fuel is to be sprayed directly into the cylinder. During the scavenging phase, the waste gas can be exhausted through the exhaust port, and a portion of fresh air can enter into the cylinder via the scavenging port without losing fuel; however, the atomizing efficiency of the aforesaid engine is much worse than the engine with carburetor, such as the fuel not being sprayed evenly.

The atomized fuel drops have to be gasified before being burned. But in high speed running condition, the atomized fuel drops can be burned completely within a very short combustion period. As a result of the combustion speed being limited, the power can not increased; during the engine running at a high speed, a lot of atomized fuel drops would be exhausted out of the exhaust port before being burned thoroughly; therefore, a heavy fuel consumption and air pollution will be resulted.

SUMMARY OF THE INVENTION

This invention relates to a reciprocating type of internal combustion engine, particularly an internal combustion engine, in which the fuel is first sprayed into the gasifying chamber of the piston for gasifying before flowing into the cylinder to mix with the air.

The object of the present invention is to provide a reciprocating type of internal combustion engine, which can consume less fuel, and can lower the HC contained in the exhuasted gas.

Another object of the present invention is to provide a reciprocating type of internal combustion engine, in which the fuel, before entering into the cylinder, will absorb the heat of the piston to gasify completely so as to lower the piston temperature. The gasified fuel will then enter into the cylinder to mix with the air entered into the cylinder via the scavenging ports so as to make a well mixture, and to increase the burning efficiency of the fuel. Since the burning of the gasified fuel has faster burning speed, it can provide more horsepower and minimize air pollution.

A further object of the present invention is to provide a reciprocating type of internal combustion engine, in which the fuel can absorb heat during the gasifying phase so as to lower the temperature of the crankcase, and the temperature of air entered into the cylinder via the crankcase and scavenging passage will also be lowered to some extent; that feature will increase the air-intake efficiency. It is apparent that whenever the intake air volume is increased, the power will also be increased.

A still further object of the present invention is to provide a reciprocating type of internal combustion engine, which has a simple and economic structure without using carburetor, but it still can have the fuel gasified completely.

The aforesaid reciprocating type of internal combustion engine that can fulfil the above mentioned objects and other objects comprises:

a cylinder, which includes a main scavenging port, an auxiliary scavenging port, a third scavenging port, and an exhaust port on the inner surface thereof; the upper edges of the aforesaid main and auxiliary ports and third scavenging port are positioned at almost the same height, but positioned under the upper edge of the exhaust port;

a spraying nozzle and its outlet on the inner surface of the aforesaid cylinder, and the outlet of the spraying nozzle is positioned above the third scavenging port;

a piston which moves reciprocatingly in the cylinder, and, in the piston, there is a gasifying chamber that has only one outlet on the body portion of the piston, and the outlet can be set, upon the piston moving back and forth, in alignment with the outlet of the spraying nozzle and the third scavenging portion;

the air passages for conveying fresh air from crankcase into the cylinder via the main scavenging and the auxiliary ports.

During the power stroke, the piston will be pushed downwards by the inflated burned gas to cause the outlet of the gasifying chamber to be in alignment with the outlet of the spraying nozzle. The spraying nozzle controlled with a micro-processor will spray a suitable volume of fuel into the gasifying chamber directly. The fuel in the gasifying chamber will be gasified as a result of absorbing the high temperature heat in the piston head. During the piston moving downwards until the outlet of the gasifying chamber being in alignment with the third scavenging port, the inflated gasified fuel in the gasifying chamber will reversely flow, via the third scavenging port, into the third scavenging passage for storage therein. After the piston moving downwards further, the exhaust port wil be opened first to exhaust the waste gas out of the cylinder, i.e., the exhaust stroke; then, the main and auxiliary scavenging ports and the third scavenging port will be opened simultaneously; the compressed air in the crankcase will, via the main and auxiliary scavenging ports, flow into the cylinder, and simultaneously the gasified fuel in the third scavenging passage will be pushed into the cylinder, i.e., the scavenging stroke. Upon the piston reaching the LDC, the crank shaft will move upwards as a result of intertia effect. Upon the piston moving upwards until closing the scavenging ports and the exhaust port, it is called the compression stroke. During the compression stroke, the outlet of the gasifying chamber will again be in alignment with the third scavenging port. In that case, a portion of the gasified fuel generated during the exhaust or the scavenging stroke and left in the gasifying chamber will again reversely flow into the third scavenging passage.

DETAILED DESCRIPTION

Figures 1, 2, 3:
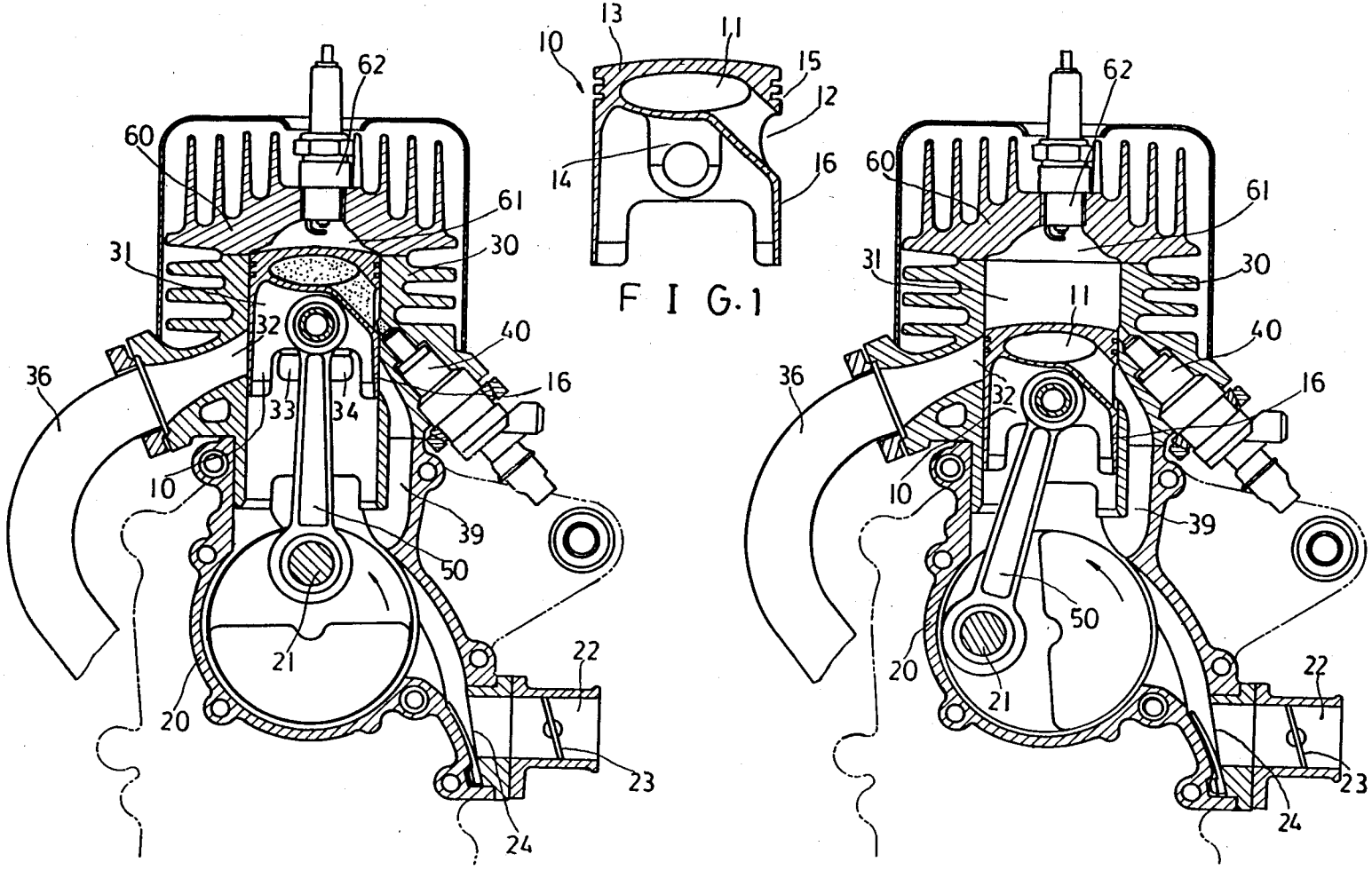
FIG. 1 is a sectional view of an enbodiment of piston according to the present invention, showing the gasifying chamber and its outlet thereof.
FIG. 2 is a sectional view of the internal combustion engine according to the present invention, showing the piston being at the TDC (top dead center), and the gasifying chamber being in alignment with the spraying nozzle.
FIG. 3 is similar to FIG. 2 except the piston being at the power stroke position; and the gasifying chamber outlet being in alignment with the third scavenging port.

FIG. 1 illustrates a sectional view of the piston 10 according to the present invention. Inside the piston 10, there is gasifying chamber 11, which has only one outlet 12, and the rest part thereof is closed completely. The gasifying chamber 11 is located between the piston head 13 and the piston boss 14. The outlet 12 of the gasifying chamber 11 is furnished on the piston wall 16 under the piston ring groove 15.

Figure 4:
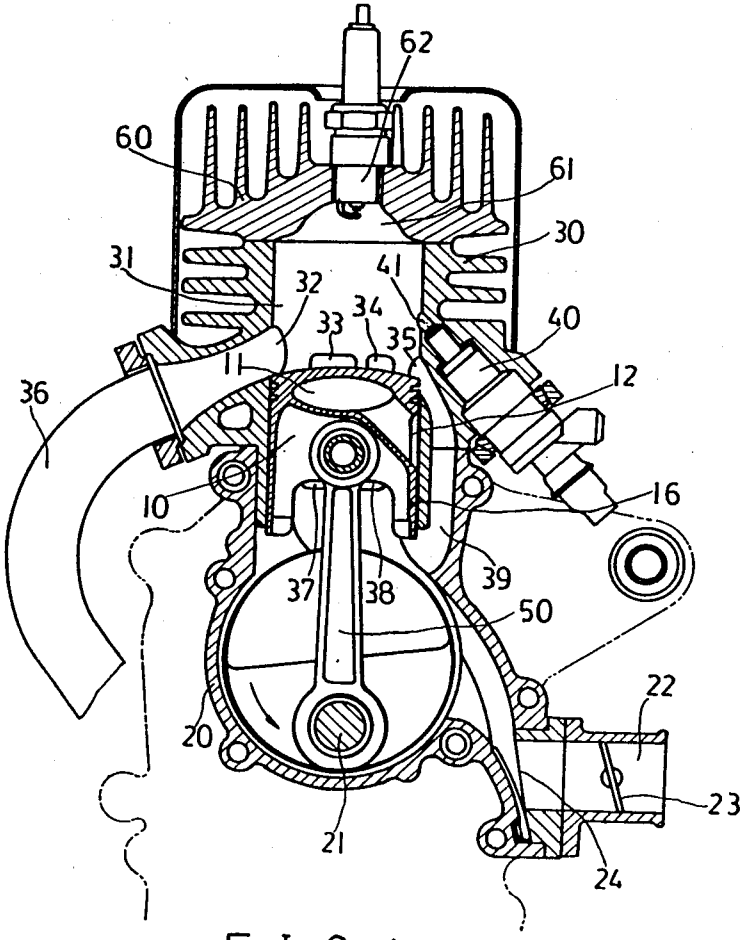
FIG. 4 is similar to FIG. 2 except the piston being near the LDC (lower dead center) position, and the various scavenging ports and the exhaust port being opened.

FIG. 4 illustrates the major structure of a two-stroke internal combustion engine according to the present invention, which comprises:

a crankcase 20 with a crank shaft 21 mounted therein; the crankcase 20 is in communication with an intake passage 22 that includes a valve 23 for controlling the flowing volume of air and a reed valve 24; the reed valve 24 merely permits the fresh air to enter into, via the intake passage, the crankcase 20 in one-way manner;

a cylinder 30 being supported with the crankcase 20; the cylinder wall 31 is furnished with an exhaust port 32, two sets of main scavenging ports 33 and auxiliary scavenging ports 34 (being disposed symmetrically, and FIG. 4 showing only one set), and a third scavenging port 35; the upper edges of the main and auxiliary scavenging ports 33 and 34, and the third scavenging port 35 are almost positioned on the same level, and all positioned under the upper edge of the exhaust port 32; the exhaust port 32 is in communication with an exhaust passage 36; those main and auxiliary scavenging ports 33 and 34 are in communication with the crankcase 20 via a main and an auxiliary scavenging passages 37 and 38 respectively; the third scavenging port 35 is in communication with the crankcase 20 via the third scavenging passage 39;

a spraying nozzle 40 mounted on the cylinder 30, and the outlet 41 of the nozzle 40 is exactly positioned above the third scavenging port 35 on the cylinder wall 31;

a piston 10 to move reciprocatingly in the cylinder 30, and the inner portion of the piston 10 has a gasifying chamber 11, of which the outlet 12 is furnished on the piston wall 16; the outlet 12 can be in alignment with the outlet 41 of the nozzle and the third scavenging port 35 respectively during the piston 10 moving reciprocatingly;

a link 50 for connecting the piston 10 and the crank shaft 21 together; and a cylinder head 60 mounted on the cylinder 30, and a combustion chamber 61 is formed by means of the cylinder head 60 and the cylinder 30; the cylinder head 60 is mounted with a spark plug 62, which can, at a suitable given time, ignite the compressed gas mixture of fuel and air in the combustion chamber 61 to generate a mechanical power.

FIG. 2 illustrates the piston being moved in the vicinity of the TDC (top dead center), and shows the gas mixture of fuel and air in the combustion chamber 61 having been ignited by the spark plug 62, and the piston to be pushed downwards immediately by the burned and inflated gas, i.e., the starting moment of the power stroke. In that moment, the outlet 12 of the gasifying chamber 11 is exactly in alignment with the outlet 41 of the spraying nozzle so as to facilitate the nozzle 40 to spray the fuel into the gasifying chamber 11 directly.

Upon the piston 10 moving downwards from TDC, the fuel entered into the gasifying chamber 11 would absorb the high temperature heat from the piston head 13 to gasify the fuel.

FIG. 3 illustrates the piston being in the power stroke and the outlet 12 of the gasifying chamber being exactly in alignment with the third scavenging port 35. In that case, the inflated gasified fuel will, via the third scavenging port 35, flow back into the third scavenging passage 39 for storage.

Referring to FIG. 4 again, there shows the piston 10 being positioned in the vicinity of the LDC; simultaneously, the exhaust port 32 and the scavenging ports 33, 34 and 35 are opened; the fresh air will, via the main and auxiliary scavenging ports 33 and 34, enter into the cylinder 30; simultaneously, the gasified fuel originally stored in the third scavenging passage 39 will, via the third scavenging port 35, enter into the cylinder head portion, while the waste gas in the cylinder is exhausted into the exhausting passage 36 via the exhaust port 32.

Since the upper edge of the exhaust port 32 is above all the upper edges of the various scavenging ports 33, 34 and 35, the exhaust port 32 is opened earlier than all the scavenging ports 33, 34 and 35, and closed later than all the aforesaid scavenging ports.

In order to avoid blow-off, the third scavenging port 35 is furnished at a position away from and opposite to the exhaust port 32; between the exhaust port 32 and the third scavenging port 35, there are pairs of main scavenging ports 33 and auxiliary scavenging ports 34 being furnished symmetrically; therefore, the gasified fuel stream injected from the third scavenging port 35 towards the cylinder head portion, during the scavenging stroke, will be blocked by the fresh air stream entered from the main scavenging port 33 and the auxiliary scavenging port 34, i.e., the gasified fuel stream would not be leaked out of the exhaust port 32 so as to minimize the consumption of fuel and reduce the HC contained in the exhausted gas.

Figure 5:
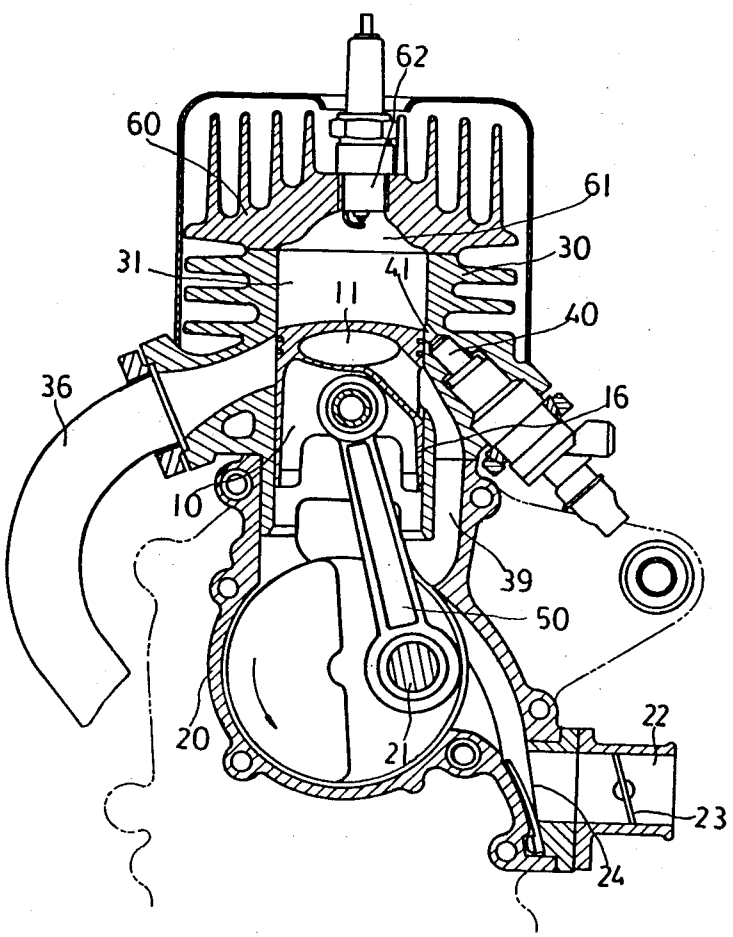
FIG. 5 is similar to FIG. 2 except the piston being at the compression stroke, and the gasifying chamber outlet being in alignment with the third scavenging port again.

FIG. 5 illustrates the piston 10 being positioned in the compression stroke, and the outlet 12 of the gasifying chamber and the third scavenging port 35 being in alignment with each other again. In that case, a portion of fuel unable to be gasified during the time of the outlet 12 of the gasifying chamber being in the first alignment with the third scavenging port 35 (that portion of fuel having been fully gasified by absorbing the heat during the exhaust and scavenging strokes) can flow reversely into the third scavenging passage 39 for temporary storage.

In other words, the fuel sprayed directly into the gasified chamber 11 can fully be gasified by means of the heat absorbed from the piston during the cycle time. The gasified and inflated gas in the gasifying chamber 11 can reversely flow into the third scavenging port 39 for temporary storage during starting of the power stroke and during compression stroke.

The spraying nozzle 40 is the general commercialized solenoid valve type of spraying nozzle to supply fuel at a constant pressure. The spraying volume is determined by the opening time of the solenoid valve. There are various kinds of signal sensors, such as temperature sensor, the sensor of valve opening, RPM sensor, the sensor for instant acceleration or intake volume sensor, etc.; all the signal generated will be coupled into a micro-processor so as to control the spraying volume and the spraying time. The best spraying volume and the best time can be obtained by testing, and then they are stored in the micro-processor for exactly controlling the spraying volume and the spraying time. (For instance, during the starting moment, the fuel is to be sprayed into the cylinder directly; after the engine being warmed up and running normally, the fuel is to be sprayed into the gasifying chamber of the piston; during special acceleration additional fuel will be sprayed.)

Since the high temperature heat of the piston head is to be absorbed by the fuel within the gasifying chamber, the temperature of the piston can be lowered, and the heat to be transmitted to the crankcase will also be lowered; therefore, the temperature of the fresh air entered into the cylinder via the crankcase will be reduced so as to increase the intake efficiency.

Moreover, the pre-gasified fuel will have a fast and complete combustion than the atomized fuel so as to increase the horse power of the internal combustion engine and to reduce the air pollution caused by the exhausted gas.

Briefly, the present invention has the following advantages:

(a) to save fuel; (b) to increase the output horsepower; (c) to minimize air pollution caused by the exhausted gas; (d) to increase the RPM of the engine; (e) to have a lower atomized requirement of the spraying nozzle.

The aforesaid embodiment is used to describe, in detail, the object, the features and the functions of the present invention; any change or modification made to the present invention by any person skilled in the art is deemed within the spiritual scope of the present invention. The patent scope of the present invention may only be defined by the claims thereof.

I claim:

1. An internal combustion engine comprising:

a cylinder having an exhaust port, several scavenging ports including a third scavenging port on the wall thereof;

a third scavenging passage being in communication with said third scavenging port;

a spraying nozzle mounted on said cylinder, an outlet of said spraying nozzle being positioned above said third scavenging port;

a device for admitting external air into said cylinder via said several scavenging ports; and a piston that reciprocates within said cylinder, said piston being furnished with a gasifying chamber into which fuel is sprayed from said spraying nozzle, the only outlet therefrom being provided on the wall of said piston; and with the piston moving, said outlet being in alignment with said outlet of said spraying nozzle and said third scavenging port respectively.

2. An internal combustion engine as claimed in claim 1, wherein said gasifying chamber is positioned between the piston head and the piston boss of said piston.

3. An internal combustion engine as claimed in claim 1, wherein said spraying nozzle can be adaptively controlled with a micro-processor for regulating the spraying time of fuel; and said spraying nozzle can directly spray the fuel into said gasifying chamber of said piston and can directly spray the fuel into said cylinder.

* * * * *